US006455238B1

(12) United States Patent
Landry-Coltrain et al.

(10) Patent No.: US 6,455,238 B1
(45) Date of Patent: Sep. 24, 2002

(54) PROTECTIVE OVERCOAT FOR PHOTOGRAPHIC ELEMENTS

(75) Inventors: Christine J. Landry-Coltrain, Fairport; Linda M. Franklin, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/832,778

(22) Filed: Apr. 12, 2001

(51) Int. Cl.[7] ..... G03C 1/76; G03C 1/74; G03C 11/22; G03C 11/08

(52) U.S. Cl. ..... 430/496; 430/350; 430/531; 430/536; 430/961

(58) Field of Search ..... 430/350, 496, 430/536, 961, 537, 531, 533, 523, 14, 432

(56) References Cited

U.S. PATENT DOCUMENTS

| | | | | |
|---|---|---|---|---|
| 2,706,686 A | | 4/1955 | Hilborn | 430/350 |
| 4,419,434 A | * | 12/1983 | Molaire et al. | 430/496 |
| 4,554,235 A | * | 11/1985 | Adair et al. | 430/961 |
| 5,856,051 A | | 1/1999 | Yau et al. | 430/537 |
| 5,866,282 A | * | 2/1999 | Bourdelais et al. | 430/536 |
| 6,197,482 B1 | * | 3/2001 | Lobo et al. | 430/536 |
| 6,203,970 B1 | | 3/2001 | Chari | 430/350 |

* cited by examiner

*Primary Examiner*—Richard L. Schilling
(74) *Attorney, Agent, or Firm*—Chris P. Konkol

(57) ABSTRACT

A photographic element is disclosed comprising a support, at least one silver-halide emulsion layer superposed on the support and a processing-solution-permeable overcoat overlying the silver-halide emulsion layer that becomes water resistant in the final product. In particular, the overcoat comprises an open-pore membrane of a water-insoluble polymer, the membrane layer being made by dissolving homogeneously the polymer in a solvent mixture, the solvent mixture comprising at least one solvent which is a relatively good solvent for the water-insoluble polymer and at least one solvent which is a relatively poor solvent for the water-insoluble polymer, wherein the relatively poor solvent has a higher boiling point than the relatively good solvent, coating the dissolved mixture onto the at least one silver halide light-sensitive emulsion layer, and then drying to remove approximately all of the solvents to obtain the open-pore membrane. The invention is also directed to a method of processing the above-described photographic element, in which a latent image in the imaging element is developed to provide an imaged photographic element, and the porous-membrane layer is fused to form a water-resistant protective overcoat.

12 Claims, No Drawings

PROTECTIVE OVERCOAT FOR PHOTOGRAPHIC ELEMENTS

FIELD OF THE INVENTION

A protective overcoat for photographic elements is disclosed. More particularly, the protective overcoat comprises a porous membrane that is present on the photographic element before exposure and processing and which is permeable to processing solutions. Subsequent to processing, the photographic element is heated to substantially close the pores of the overcoat, so that it provides water resistance, fingerprint resistance, and scratch protection to the surface of the photographic element.

BACKGROUND OF THE INVENTION

Typically, a silver-halide photographic element contains light sensitive silver halide in a hydrophilic emulsion. An image is formed in the element by exposing the silver halide to light, or to other actinic radiation, and developing the exposed silver halide to reduce it to elemental silver. In color photographic elements, a dye image is formed as a consequence of silver halide development by one of several different processes. The most common is to allow a by-product of silver halide development, oxidized silver-halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Gelatin has been used exclusively in a variety of silver halide photographic systems as the primary binder due to its many unique properties, one of which is the water-swellable property. This rapid swelling allows processing chemistry to proceed and images to be formed. However, due to this same property, photographic images, whether they are on film or paper, need to be handled with extreme care so as not to come in contact with any aqueous solutions that may damage the images. Thus, although gelatin, and similar natural or synthetic hydrophilic polymers, have proven to be the binders of choice for silver-halide photographic elements to facilitate contact between the silver halide crystal and aqueous processing solutions, they are not as tough and mar-resistant as would be desired. This is especially true in view of the handling commonly encountered by an imaged photographic element. The imaged element can be easily marked by fingerprints, it can be scratched or torn, and it can swell or otherwise deform when it is contacted with liquids.

There have been attempts over the years to provide protective layers for gelatin based photographic systems that will protect the images from damages by water or aqueous solutions. Many protective layers have been proposed for photographic elements that need to be applied after photoprocessing. However, there is a need for a protective layer that could be incorporated as part of the photographic element as manufactured.

Commonly assigned, copending application U.S. Pat. No. 6,203,970 describes a non-porous overcoat layer that is present on the photographic element prior to exposure, which layer comprises a hydrophobic thermoplastic polymer and a hydrophilic component. The processing solutions permeate the layer by dissolving away the hydrophilic component and creating pores. After processing, the layer is heated so as to close the pores and provide a protective layer.

With this invention, a significant amount of material must be removed from the layer during processing and this leads to waste and contamination of the processing solutions.

U.S. Pat. No. 5,856,051 describes a protective overcoat comprising a mixture of gelatin and hydrophobic polymer particles that have a particular melting point range. After photoprocessing, including development, to produce the image, the photographic element is thermally fused, so that the hydrophobic polymer particles form a water-resistant protective overcoat. The element described in the '051 patent, however, suffers in that this protective overcoat is easily scratched.

Commonly assigned, copending application U.S. Ser. No. 09/312,378 (Docket 79332) describes a protective overcoat comprising two layers, an uppermost layer comprising abrasion resistant particles and a second layer below this comprising gelatin in admixture with hydrophobic polymer particles that have a particular melting point range. After photoprocessing, including development, to produce the image, the photographic element is thermally fused so as to provide a water-resistant and dry scratch-resistant protective overcoat. The element described in this patent, however, suffers in that this protective overcoat is easily scratched when the element is wet.

U.S. Pat. No. 5,853,926 describes a protective overcoat applied during manufacturing that comprises polymer particles and a polymer latex binder. The element described in this patent, however, suffers in that the overcoat is not porous prior to processing and the speed of development is slow.

There remains a need for a water-resistant protective overcoat that can be incorporated into the photographic product during manufacturing, allows for appropriate diffusion of photographic processing solutions, and does not require coating operation after exposure and processing.

The present invention discloses a uniquely structured overcoat that allows the photographic processing solutions to diffuse through for image formation, and then provides water resistance, fingerprint resistance, and improved scratch resistance properties.

SUMMARY OF THE INVENTION

The present invention relates to a photosensitive photographic element comprised of a support, at least one silver-halide light-sensitive emulsion layer, and a porous-membrane layer, said layer comprising an open-pore membrane of a water-insoluble polymer, the membrane layer being made by homogeneously dissolving the polymer in a solvent mixture, the solvent mixture comprising at least one solvent which is a relative good solvent for the water-insoluble polymer and at least one solvent which is a relatively poor solvent for the water-insoluble polymer, wherein the relatively poor solvent has a higher boiling point than the relatively good solvent, coating the dissolved mixture onto the at least one silver halide light-sensitive emulsion layer, and then drying to remove approximately all of the solvents to obtain the open-pore membrane.

The invention is also directed to a method of processing the above-described photographic element, in which the imaging element is developed to provide an imaged photographic element, and the porous-membrane layer is fused to form a protective overcoat.

By means of the present invention, an imaging element can be obtained that will provide, in the imaged product, improved wet and dry abrasion resistance, scratch resistance, fingerprint resistance, water resistance, and stain resistance.

DETAILED DESCRIPTION OF THE INVENTION

As indicated above, the present invention provides an imaged photographic element having an overcoat that imparts both water resistance, fingerprint resistance, and abrasion resistance. The protective overcoat of this invention can be achieved in the following manner. An uppermost porous membrane is coated over the photosensitive layers. In order for the membrane layer to be sufficiently porous, however, the water-insoluble polymer must be coated from a solvent mixture combination such that an open-pore membrane structure will be formed when the solution is coated and dried, in accordance with the known technique of "dry-phase inversion." The formation of an open-pore membrane is accomplished by using a mixture of an essentially good and an essentially poor solvent for the water-insoluble polymer. As noted above, the essentially poor solvent has a boiling point that is higher than that of the good solvent. When the solution is coated or cast onto a support and dried, the essentially good solvent evaporates faster than the poor solvent, forming the membrane structure of the layer when the polymer phase separates from the solvent mixture. The open-pore structure results when the essentially good solvent and essentially poor solvent are both removed by drying.

After the element is exposed and processed, heat and/or pressure can be applied to the element to substantially close the pores of the open pore membrane so that it becomes transparent and provides protection against water, stains, fingerprints, and scratches. Various methods can be used such as hot presses, hot rolls, hot air, IR-radiation, high frequency heating, and a fusing belt or roller apparatus. For example, the element can be passed through a fuser consisting of rollers or a belt and a roller. Temperatures can range from slightly above ambient temperature to an upper temperature limited only by the thermal stability of the support, the photosensitive layers, and the membrane components. Temperatures should not be so high as to cause delamination of layers within the support, or any bubbles or defects to form in the support or the open-pore membrane. The heating time is not limited.

The water-insoluble polymer that can be used in the invention may be, for example, a derivatized cellulose such as a cellulose ester, including, for example, cellulose diacetate, cellulose triacetate, cellulose acetate propionate, cellulose acetate butyrate (CAB), or cellulose nitrate, polyacrylates or polymethacrylates such as poly(methyl methacrylate), poly(phenyl methacrylate), polymethylacrylate and copolymers with acrylic or methacrylic acid, sulfonates, polyesters, polyurethanes, polysulfones, urea resins, melamine resins, urea-formaldehyde resins, polyacetals, polybutyrals, epoxies and epoxy acrylates, phenoxy resins, polycarbonates, vinyl acetate polymers and copolymers, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers, or styrene-butadiene copolymers, and combinations thereof. Cellulose ester derivatives, such as cellulose diacetates and triacetates, cellulose acetate propionate, cellulose acetate butyrate, cellulose nitrate, and mixtures thereof are preferred.

The water-insoluble polymer or polymers are preferably used in the total amount of between 2 and 50, more preferably, between 3 and 20% by weight in the coating composition, including solvents.

The choice of a good and poor solvent for the water-insoluble polymer will be effectively determined by the specific choice of polymer. The good solvent that can be used in the invention includes alcohols such as methanol, ethanol, n-propyl alcohol, isopropyl alcohol, isobutyl alcohol, Dowanol® solvents, glycols, ketones such as acetone, 2-butanone, 3-pentanone, cyclopentanone, and cyclohexanone, ethyl acetate, methylacetoacetate, diethylether, tetrahydrofuran, acetonitrile, dimethylformamide, dimethylsulfoxide, pyridine, chlorinated solvents such as methylene chloride, chloroform, carbon tetrachloride, and dichloroethane, hexane, heptane, cyclopentane, cyclohexane, toluene, xylenes, nitrobenzene, and mixtures thereof.

The poor solvent that can be used in the invention may be, for example, alcohols such as ethanol, n-propyl alcohol, isopropyl alcohol, isobutyl alcohol, 2-methyl-2,4-pentanediol, and Dowanol® solvents, glycols, ketones such as 2-butanone, 3-pentanone, cyclopentanone, and cyclohexanone, ethyl acetate, methylacetoacetate, diethylether, tetrahydrofuran, acetonitrile, dimethylformamide, dimethylsulfoxide, pyridine, chlorinated solvents such as carbon tetrachloride and dichloroethane, hexane, heptane, cyclopentane, cyclohexane, toluene, xylenes, nitrobenzene, water, and mixtures thereof.

Information on the solvent power (good and poor solvent quality) for polymers can be found in the chemical literature and references, including the Textbook of Polymer Science, second edition, Fred W. Billmeyer. Jr., John Wiley & Sons, New York, 1971, Chapter 2; and Polymer Chemistry, The Basic Concepts, Paul C. Hiemenz, Marcel Dekker, Inc., New York, 1984, Chapter 1. Preferably the ratio of the amount of good solvent to poor solvent is a function of the ternary phase diagram of the specific choices of polymer, good solvent, and poor solvent.

By the term "open-pore" is meant that the pores are occupied by air and to some extent communicate with each other such that a substantial number of continuous, albeit circuitous, channels are formed through the membrane. The solution composition and conditions of coating and drying should be such that, according to the process, a porous membrane having a minimum porosity of 20% (by volume), preferably at least 40% porosity (by volume) is obtained. The pore volume to some extent may depend, however, on various factors such as the ratio of the good and poor solvent, the choice of solvents and the concentration of the polymer or other components in the coating composition.

Fusing typically requires a pressure roller or belt and drying of the imaged element before fusing. The fusing temperature range is preferably between 80° C. to 250° C., preferably 100° C. to 180° C. More preferably, the fusing temperature is above the boiling point of water, that is, above 100° C. Commonly assigned U.S. Pat. No. 5,266,455, for example, describes the use of a belt fuser on photographic elements, which reference is hereby incorporated by reference in its entirety. An example of a fusing operation is described in Kodak U.S. Pat. No. 6,083,676 entitled: "Method for Applying a Protective Overcoat to a Photographic Element using a Fuser Belt", hereby incorporated by reference. Since the element may come in contact with the drive or transport mechanisms of element manufacturing and photoprocessing equipment prior to clarification/ conversion of the porous membrane, and abrasive equipment or other abrasive conditions after clarification/conversion of the membrane, additives such as filler particles, surfactants, lubricants, crosslinking agents, matte particles and the like may be added to the element to the extent that they do not degrade the properties of interest.

Filler particles may be used in the open-pore membrane such as silicon oxide, fumed silica, silicon oxide dispersions such as those available from Nissan Chemical Industries and DuPont Corp., aluminum oxide, fumed alumina, calcium carbonate, barium sulfate, barium sulfate mixtures with zinc sulfide, inorganic powders such as y-aluminum oxide, chromium oxide, iron oxide, tin oxide, doped tin oxide, aluminosilicate, titanium dioxide, silicon carbide, titanium carbide, and diamond in fine powder, as described in U.S. Pat. No. 5,432,050.

A dispersing agent, or wetting agent can be present to facilitate the dispersion of the filler particles. This helps to minimize the agglomeration of the particles. Useful dispersing agents include, but are not limited to, fatty acid amines and commercially available wetting agents such as Solsperse® sold by Zeneca, Inc. (ICI). Preferred filler particles are silicon oxide, aluminum oxide, calcium carbonate, and barium sulfate. Preferably, these filler particles have a median diameter less than 1.0 $\mu$m. The filler particles can be present in the amount from about 0 to 80 percent of the total solids in the dried open-pore membrane layer, most preferably in the amount from about 0 to 40 percent.

The open-pore membrane layer may include lubricating agents. Lubricants and waxes useful either in the open-pore membrane layer or on the side of the element that is opposite the open-pore membrane layer include, but are not limited to, polyethylenes, silicone waxes, natural waxes such as carnauba, polytetrafluoroethylene, fluorinated ethylene propylene, silicone oils such as polydimethylsiloxane, fluorinated silicones, functionalized silicones, stearates, polyvinylstearate, fatty acid salts, and perfluoroethers. Aqueous or non-aqueous dispersions of submicron size wax particles such as those offered commercially as dispersions of polyolefins, polypropylene, polyethylene, high density polyethylene, microcrystalline wax, paraffin, natural waxes such as carnauba wax, and synthetic waxes from such companies as, but not limited to, Chemical Corporation of America (Chemcor), Inc., Michelman Inc., Shamrock Technologies Inc., and Daniel Products Company, are useful.

The open-pore membrane layer may include coating aids, wetting aids, and surfactants such as nonionic fluorinated alkyl esters such as FC-430®, FC-431®, FC-10®, FC-171® sold by Minnesota Mining and Manufacturing Co., Zonyl® fluorochemicals such as Zonyl-FSN®, Zonyl-FTS®, Zonyl-TBS®, Zonyl-BA® sold by DuPont Corp.; other fluorinated polymer or copolymers such as Modiper F600® sold by NOF Corporation, polysiloxanes such as Dow Corning DC 1248®, DC200®, DC510®, DC 190® and BYK 320®, BYK 322®, sold by BYK Chemie and SF 1079®, SF1023®, SF 1054®, and SF 1080® sold by General Electric, and the Silwet® polymers sold by Union Carbide; polyoxyethylene-lauryl ether surfactants; sorbitan laurate, palmitate and stearates such as Span® surfactants sold by Aldrich; poly (oxyethylene-co-oxypropylene) surfactants such as the Pluronic® family sold by BASF; and other polyoxyethylene-containing surfactants such as the Triton X® family sold by Union Carbide, ionic surfactants, such as the Alkanol® series sold by DuPont Corp., and the Dowfax® family sold by Dow Chemical.

The incorporation of water soluble polymers preferably at less than 20% by weight, more preferably at 1–15% by weight based on the total dry weight of the membrane layer can improve the developability and dye formation rate of the imaging formation layer, especially noticeable for the layers closer to the support. During processing, these minor additives are substantially removed from the coating and therefore do not interfere with the formation of water resistance layer by fusing treatment. The average molecular weight of the water-soluble polymers is between 1,000 and 200,000, preferably between 1,500 and 20,000. A wide variety of nonionic, anionic or cationic water soluble polymers can be used in the present invention including polyacrylamides, polymethacrylamide, poly(acrylic acid), poly(methacrylic acid), poly(ethylene oxide), poly(oxymethylene), poly(vinyl alcohol), polyvinylamine, polyvinylpyrrolidone, poly(ethyl oxazoline), poly(vinyl pyridine), methyl cellulose, hydroxy propyl cellulose, hydroxy ethyl cellulose, hydroxy propyl methyl cellulose, poly(ethylene imine), poly(ethylene glycol methacrylate), poly(hydroxyethyl methacrylate), poly(vinyl methyl ether), poly(styrene sulfonic acid), poly(ethylene sulfonic acid), poly(vinyl phosphoric acid), poly(maleic acid), or copolymers containing sufficient amount of hydrophilic functional groups to be water soluble. If too much water soluble polymer is present, then it is not completely removed during short processing times and interferes with the water-resistance properties of the fused protective overcoat. Also, contamination of the processing solutions becomes a problem.

The open-pore membrane layer may include crosslinking agents, such as organic isocyanates such as tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate; aziridines such as taught in U.S. Pat. No. 4,225,665; ethyleneimines such as Xama-7® sold by EIT Industries; blocked isocyanates such as CA BI-12 sold by Cytec Industries; melamines such as methoxymethylmelamine as taught in U.S. Pat. No. 5,198,499; alkoxysilane coupling agents including those with epoxy, amine, hydroxyl, isocyanate, or vinyl functionality; Cymel® crosslinking agents such as Cymel 300® , Cymel 303®, Cymel 1170®, Cymel 1171® sold by Cytec Industries; and bis-epoxides such as the Epon® family sold by Shell. Other crosslinking agents include compounds such as aryloylureas, aldehydes, dialdehydes and blocked dialdehydes, chlorotriazines, carbamoyl pyridiniums, pyridinium ethers, formamidinium ethers, and vinyl sulfones. Such crosslinking agents can be low molecular weight compounds or polymers, as discussed in U.S. Pat. No. 4,161,407 and references cited.

The open-pore membrane layer may include low molecular weight or polymeric plasticizers to aid in the fusing step. These plasticizers are compounds that typically have low glass transition temperatures. Plasticizers useful in the open-pore membrane layer include, but are not limited to, poly (ethylene glycol), poly(propylene glycol), chlorinated paraffins such as those sold under the tradenames of Chlorowax® (Occidental Chemical Corp.) and Paroil® (Dover Chemical, Inc.), aliphatic polyesters, such as polyester sebacate available commercially as Paraplex® G-25 from C.P. Hall Co., poly(butylene glycol adipates) available commercially as Drapex® polymeric plasticizers from Witco Corporation, poly(ethylene succinate), poly (hexamethylene sebacate), or poly(butylene adipate), polycaprolactone, diphenyl phthalate, di(2-ethylhexyl phthalate), tri(phenyl phosphate), and p-phenylene bis (diphenyl phosphate).

The useful thickness range of the open-pore membrane layer used in the invention is from about 1 μm to about 100 μm, preferably from about 2 μm to about 30 μm.

The imaging element of the invention can contain one or more conducting layers such as an antistatic layer to prevent undesirable static discharges during manufacture and processing. This may be added to either side of the element, preferably close to the support. Antistatic layers conventionally used for color films and papers have been found to be satisfactory, such as those in U.S. Pat. No. 5,147,768, the disclosure of which is hereby incorporated by reference. These antistatic agents are preferably dispersed in a film-forming binder.

The imaged photographic elements protected in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are preferred imaged photographic elements for use in this invention.

The photographic elements in which the images to be protected are formed can have the structures and components shown in Research Disclosure 37038. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, glass, and reflective bases such as paper, coated papers, melt-extrusion-coated paper, and laminated papers, such as biaxally oriented support laminates. Biaxally oriented support laminates are described in U.S. Patents U.S. Pat. Nos. 5,853,965; U.S. 5,866,282; U.S. 5,874,205; U.S. 5,888,643; U.S. 5,888,681; U.S. 5,888,683; and U.S. 5,888,714 incorporated by reference herein. These biaxally oriented supports include a paper base and a biaxially oriented polyolefin sheet, typically polypropylene, laminated to one or both sides of the paper base. At least one photosensitive silver halide layer is applied to the biaxially oriented polyolefin sheet. Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. 4,279,945 and U.S. 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, lasers, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element or color paper element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The layers described above may be coated by conventional coating means onto a support material commonly used in this art. Coating methods may include, but are not limited to, wound wire rod coating, knife coating, slot coating, slide hopper coating, gravure coating, spin coating, dip coating, skim-pan-air-knife coating, multilayer slide bead, blade coating, curtain coating, multilayer curtain coating and the like. Some of these methods allow for simultaneous coatings of more than one layer, which is preferred from a manufacturing economic perspective if more than one layer or type of layer needs to be applied. The support may be stationary, or may be moving so that the coated layer is immediately drawn into drying chambers.

The following examples further illustrate the invention.

EXAMPLES

In the following Examples, porous membrane coatings according to the present invention were subjected to the following tests.

Test for Water Resistance

Since Ponceau Red dye is known to stain gelatin through ionic interaction, it was used to test for water resistance. Gelatin is not water resistant and is also readily stained. Therefore, detection of gelatin on the surface of the sample is indicative of poor water and stain resistance. The Ponceau Red dye solution was prepared by dissolving 1 gram dye in 1000 grams mixture of acetic acid and water (5 parts: 95 parts). Color photographic paper samples were processed through a modified KODAK RA12 process to obtain white Dmin samples. These processed samples were then passed through a set of rollers under pressure and heat (fusing) to convert the open-pore membrane overcoat into a non-porous water resistant layer. The water permeability test was performed by soaking fused samples in the dye solution for 10 minutes, followed by a 30-second water rinse to remove excess dye solution on the coating surface. Each sample was air dried, and reflectance density of the green channel on the soaked area was recorded. Optical density of 3 indicates a completely water permeable coating, its water resistance= 0%. Relative to an optical density of 3 being 0% water resistance and an optical density of 0 being 100% water resistant, the percent water resistance is calculated by the following equation:

$$\%\ \text{water resistance}=[1-(\text{density}/3)]\times 100$$

Test for Dry Abrasion Resistance

Exposed color photographic paper samples were processed through a KODAK RA12 process to obtain Dmax (black) samples. The samples were then fused under the conditions specified for each sample. A two-ply general purpose paper towel, with a 500 g weight on top, was pulled across the sample surface 40 times. The bottle shaped 500 g class M2 weight had a 3 cm diameter which resulted in a 7.1 $cm^2$ contact area between the towel and the sample. The sample was then visually ranked on a scale from 0 to 10, depending on the frequency and depth of the resulting scratches. A ranking of 10 indicates excellent performance with no visible damage, while a ranking of 0 indicated very poor performance with the surface totally abraded and worn.

Scratch Resistance Rankings

0 . . . Totally abraded/worn
1 . . . Dense scratches with associated haze band
2 . . . Numerous scratches with associated haze band
3 . . . Few scratches with associated haze band
4 . . . Dense, heavy scratches
5 . . . Numerous, heavy scratches
6 . . . Few, heavy scratches
7 . . . Dense, heavy scratches
8 . . . Numerous, light scratches
9 . . . Few, light scratches
10 . . . No visible damage

Test for Wet Abrasion Resistance

Exposed color photographic paper samples were processed through a KODAK RA12 process to obtain Dmax (black) samples. The samples were then fused under the conditions specified for each sample. A drop of water is placed on the fused sample and left for 10 minutes. The drop of water is blotted off and a two-ply general purpose paper towel, with a 500 g weight on top, was pulled across the sample surface 40 times. The bottle shaped 500 g class M2 weight had a 3 cm diameter which resulted in a 7.1 $cm^2$ contact area between the towel and the sample. The sample was then visually ranked on the same scale from 0 to 10 as used for the dry abrasion resistance test, depending on the frequency and depth of the resulting scratches. In addition, a scale from A through E was also used to describe damages due to the water. This scale is described as follows:

Water Damage Scratch Resistance Rankings

A . . . None
B . . . Original water spot still discernible
C . . . Speckled pattern within original water spot
D . . . Few blisters (1–3)
E . . . Numerous blisters (>3)

Test for Fingerprint Resistance

Exposed color photographic paper samples were processed through a Kodak RA12 process to obtain Dmax (black) samples. The samples were then fused under the conditions specified for each sample. A drop of a mixture of oils and glycols (to simulate finger oils) is rubbed onto the tip of a human finger (index) and then the finger is pressed onto the fused sample. The finger is removed, leaving an oily residue behind. This is left on the sample for 24 hrs, then rubbed off with a soft facial tissue. The sample was then visually examined for residual markings and damage, and given a ranking as follows:

1 . . . No fingerprint mark visible to the naked eye
2 . . . Fingerprint mark visible to the naked eye

Comparative Example 1

This Example describes the preparation of a comparative Sample No. 1. Comparative Sample No. 1 ("C-1")was prepared by coating in sequence blue-light sensitive layer, interlayer, green-light sensitive layer, UV layer, red-light sensitive layer, and a UV layer on side A of a photographic paper support. The components in each individual layer is described below.

Photographic Paper Support sublayer 1 (side A, or frontside, of the paper): resin coat (TITANOX titanium oxide and optic brightener in polyethylene)
sublayer 2: paper
sublayer 3 (side B, or backside, of the paper): resin coat (polyethylene)

Blue Sensitive Emulsion (Blue EM-1). A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 $\mu$m in edge-length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1): A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edgelength size. The emulsion is optimally sensitized by the addition of glutaryldiaminophenyldisulfide, sodium thiosulfate, tripotassium bis{2-[3-(2-sulfobenzamido) phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known to the art and the following layers were coated on the following support:

The following light sensitive silver halide imaging layers were utilized to prepare photographic print materials for the invention. The following imaging layers were coated utilizing curtain coating.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |

-continued

| Layer | Item | Laydown (mg/ft$^2$) |
|---|---|---|
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | S-4 | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | S-4 | 10.40 |
| | ST-21 | 3.698 |
| | ST-22 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | S-4 | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | S-6 | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | S-6 | 7.404 |
| | 5-chloro-2-methyl-4-isothiazolin-3-one/2-methyl-4-isothiazolin-3-one(3/1) | 0.009 |

IC-35
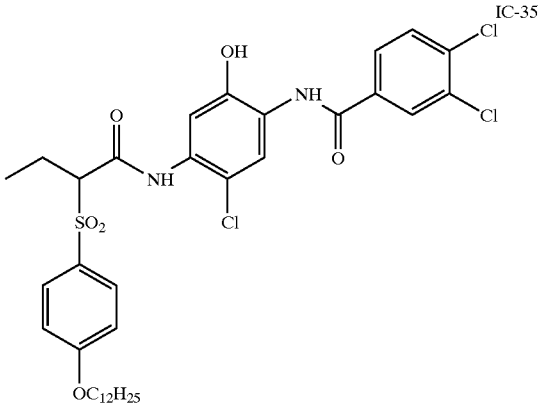
IC-36
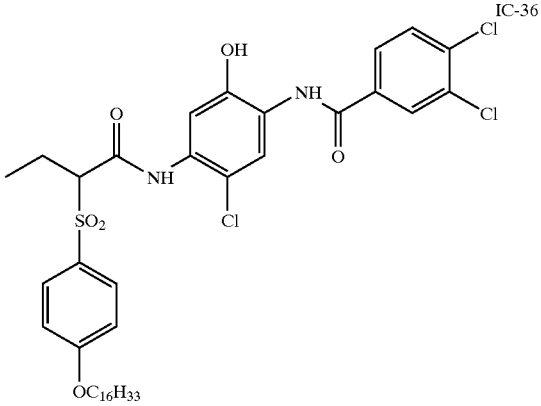
M-4
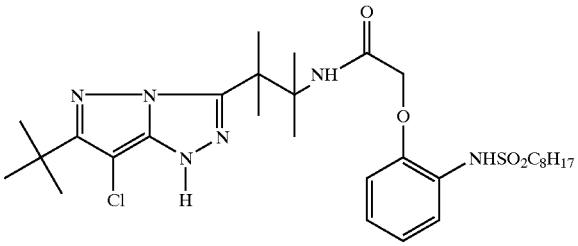
Y-4
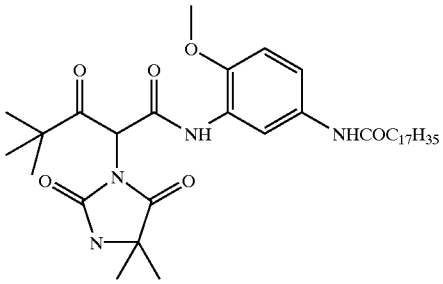
ST-16
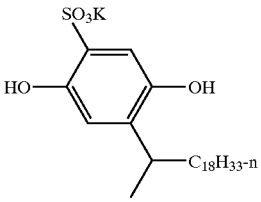
-continued
ST-4
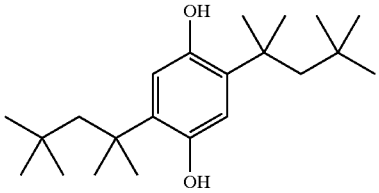
ST-21
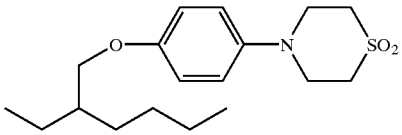
ST-22
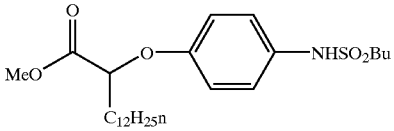
ST-23
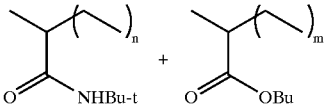
ST-24
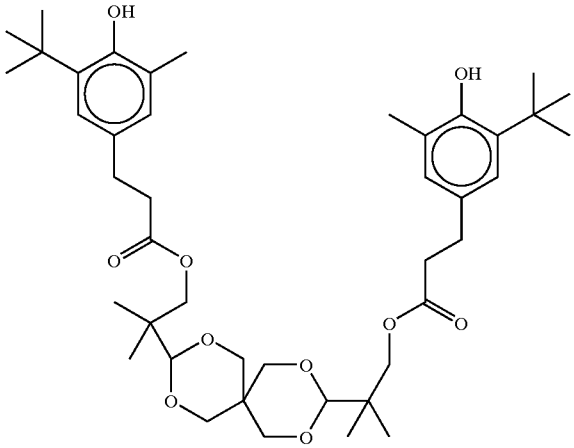
n:m 1:1 nw = 75–100,000
UV-1
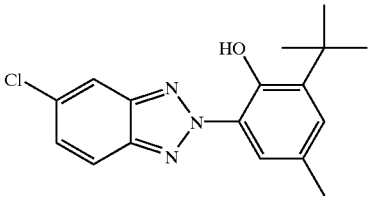
UV-2
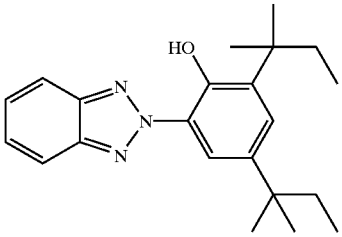

-continued

SF-1

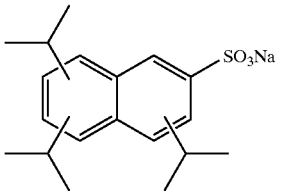

SF-2

$CF_3 \cdot (CF_2)_7 \cdot SO_3Na$

S-4 = Diundecyl phthalate

S-6 = Tris(2-ethylhexyl)phosphate

BSD-4

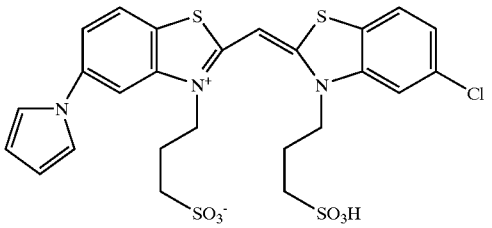

GSD-1

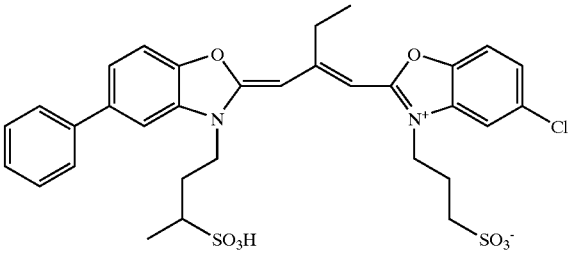

RSD-1

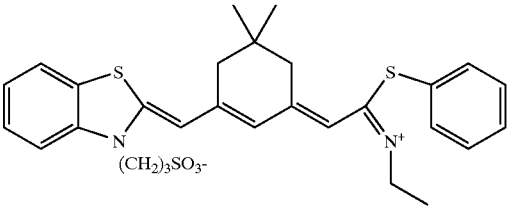

DYE-1

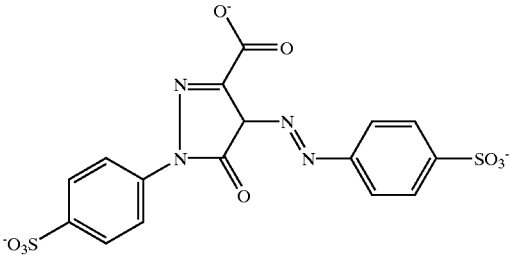

-continued

DYE-2

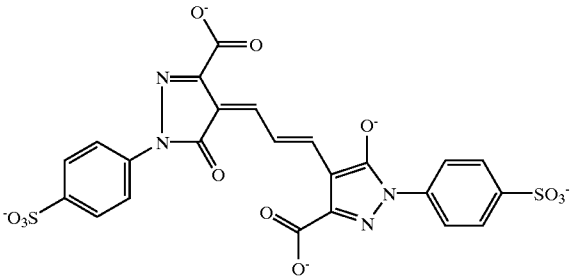

DYE-3

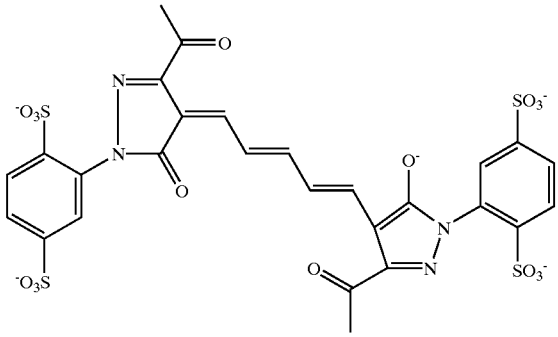

No protective overcoats of this invention were coated onto this photographic element. The photographic element then underwent photographic imaging and photographic processing to develop the image. After the imaged element was dried, it was fused between rollers, at least one of which was heated at a temperature of 149° C., at a speed of 0.43 inch per second (ips).

The element was then tested for water resistance in the Dmin (white) area, and fingerprint resistance, dry abrasion resistance, and wet abrasion resistance in the Dmax (black) area as described above.

The photographic element underwent significant color change to red due to staining of the Ponceau Red dye, with a % water resistance calculated to be 22%. A fingerprint mark was visible on the print after the fingerprint test, giving it a ranking of 2. The dry abrasion resistance was given a ranking of 10. The wet abrasion resistance was given a ranking of 0B.

Example 2

This Example illustrates the preparation of an photographic element (Sample No. 2) having a protective overcoat according to the present invention. Sample No. 2 was prepared identically to Sample No. 1 (C-1), except an open-pore membrane layer was coated on top of light sensitive layers (farthest from the support). A homogeneous solution was prepared from 8 wt. % cellulose acetate butyrate, CAB, (CAB381-20, Eastman Chemical Company), 27.6 wt. % acetone (good solvent), and 64.4 wt. % 2-methyl-2,4-pentanediol, MPD, (poor solvent). The solution was coated onto the light sensitive layers of Sample No. 1 using a calibrated coating knife, and dried to remove substantially all solvent components to form the open-pore membrane.

The photographic element then underwent photographic imaging and photographic processing to develop the image. After the imaged element was dried, it was fused between rollers, at least one of which was heated, at a temperature of 149° C. and a speed of 0.43 ips.

The element was then tested for water resistance. No red color was obtained from the application of Ponceau Red dye, with the % water resistance calculated to be 97%. The dry abrasion resistance was given a ranking of 10, and the wet abrasion resistance was given a ranking of 10A, substantially greater than the Control Sample No.1 with no protective overcoat.

Example 3

Sample No. 3 according to the present invention was prepared and coated the same as Sample No.2, except that the open-pore membrane layer was prepared from 5.0 wt. % cellulose acetate propionate, CAP482-20, (Eastman Chemical Company), 26.6 wt. % acetone, and 68.4 wt. % MPD. The photographic element then underwent photographic imaging and photographic processing to develop the image. After the imaged element was dried, it was fused between rollers, at least one of which was heated, at a temperature of 149° C. and a speed of 0.43 ips.

The element was then tested for water resistance. No red color was obtained from the application of Ponceau Red dye, with the % water resistance calculated to be 97%. No fingerprint mark was visible on the print after the fingerprint test, giving it a ranking of 1. The dry abrasion resistance was given a ranking of 9, and the wet abrasion resistance was given a ranking of 10A, substantially better than the Control Sample No. 1 with no protective overcoat.

Examples 4–5

Samples No.4 and No. 5 were prepared identically to Sample No.2, with the difference that the thickness of the protective overcoat was varied. These variations are listed in Table 1 below. The photographic elements then underwent photographic imaging and photographic processing to develop the image. After the imaged element was dried, it was fused between rollers, at least one of which was heated at a temperature of 149° C. and a speed of 0.43 ips.

The elements were then tested for water resistance, for dry abrasion resistance and wet abrasion resistance. The results are tabulated in Table 1.

TABLE 1

| Sample ID | Fused overcoat thickness (microns) | % water resistance after fusing | Dry Abrasion Ranking | Wet Abrasion Ranking |
|---|---|---|---|---|
| 1-C (comparison) | None | 22 | 10 | 0B |
| 2 (Invention) | 8 | 97 | 10 | 10A |
| 4 (Invention) | 2 | 97 | 10 | 10A |
| 5 (Invention) | 1.2 | 97 | 10 | 9A |

As shown in examples 2–5, the novel structures of this invention offer water resistance as well as wet abrasion resistance after being fused. This is clearly an improvement over Control Sample C-1, which does not give satisfactory water resistance and wet abrasion resistance properties.

The following examples show that minor amounts of additives, such as a hydrophilic component, a plasticizer, or inorganic particle, can be added to the open-pore membrane.

Example 6

Sample No. 6 was prepared and coated the same as Sample No.2, except that the open-pore membrane layer was prepared from 8 wt. % cellulose acetate butyrate, CAB, (CAB381-20, Eastman Chemical Company), 0.5 wt. % of Triton®X-100 (Aldrich Chemical Company, Inc.), 27.5 wt. % acetone, and 64.0 wt. MPD.

Example 7

Sample No. 7 was prepared and coated the same as Sample No.2, except that the open-pore membrane layer was prepared from 3.9 wt. % cellulose acetate butyrate, CAB171-15S, (Eastman Chemical Company), 1.2 wt. % cellulose acetate butyrate, CAB551-0.01, (Eastman Chemical Company), 0.5 wt. % of a chlorinated paraffin, Paroil-150A (Dover Chemical Corporation), 4.7 wt. % SNOWTEX MPD silica solution (prepared as described below), 51.15 wt. % acetone, and 38.55 wt. % MPD.

Preparation of Silica Solution

SNOWTEX MEK-ST (colloidal silica, 30 wt % in 2-butanone) was obtained from Nissan Chemical Industries, Ltd. 100.0 g of SNOWTEX MEK-ST was added to 70.0 g of 2-methyl-2,4-pentane diol (MPD) in a round-bottom flask. The flask was placed in a 35–40° C. water bath, and the mixture was roto-evaporated under full aspirator vacuum for 2.5 hrs. The net weight was 101.7 grams giving a composition of the solution to be 29.5 wt. % silica, 1.7 wt. % 2-butanone, and 68.8 wt % MPD.

Example 8

Sample No. 8 was prepared and coated the same as Sample No.2, except that the open-pore membrane layer was prepared from 4.9 wt. % cellulose acetate propionate, CAP482-20, (Eastman Chemical Company), 0.9 wt. % p-phenylene bis(diphenyl phosphate) (Eastman Chemical Company), 26.4 wt. % acetone, and 67.8 wt. % MPD. The photographic elements of examples 6–8 then underwent photographic imaging and photographic processing to develop the image. After the imaged element was dried, it was fused between rollers, at least one of which was heated, at a temperature of 149° C. and a speed of 0.43 ips.

The elements of examples 6,7 and 8 were then tested for water resistance. No red color was obtained from the application of Ponceau Red dye in any of the samples of the invention. The % water resistance was calculated, and the fingerprint resistance, the dry abrasion resistance, and the wet abrasion resistance were measured. These are reported in Table 2 showing substantially greater water resistance, fingerprint resistance, and wet abrasion resistance than the Control Sample No. 1 with no protective overcoat.

TABLE 2

| Sample ID | Fingerprint resistance Ranking | % water resistance after fusing | Dry Abrasion Ranking | Wet Abrasion Ranking |
|---|---|---|---|---|
| 1 (comparison) | 2 | 22 | 10 | 0B |
| 6 (Invention) | 1 | 97 | 9 | 9A |
| 7 (Invention) | 1 | 97 | 7 | 7A |
| 8 (Invention) | 1 | 97 | 10 | 10A |

Example 9

This Example shows that the presence of the porous membrane does not adversely affect the development time of the image during processing. Sample No. 9 was prepared and coated the same as Sample No.2, except that the open-pore membrane layer was prepared from 4.2 wt. % cellulose acetate butyrate, CAB, (CAB381-20, Eastman Chemical Company), 0.3 wt. % of polyethylene glycol (Scientific Polymer Products, Inc., nominal MW=400), 40.3 wt. % acetone, 37.2 wt. % MPD, and 18.0 wt. % water. The photographic element then underwent photographic imaging and photographic processing to develop the image. After the imaged element was dried, it was fused between rollers, at least one of which was heated, at a temperature of 171° C. and a speed of 0.43 ips.

The densities in the red, green, and blue channels were measured as a function of time of development during the photographic processing step. The results for a 30 second development time are compared to those obtained for sample 1 (that does not contain a porous membrane overcoat). These results are shown in Table 3.

TABLE 3

| Sample ID | Dmax density Red channel | Dmax density Green channel | Dmax density Blue channel | Wet Abrasion Ranking |
|---|---|---|---|---|
| 1-C (comparison) | 2.57 | 2.52 | 2.20 | 0B |
| 9 (Invention) | 2.47 | 2.32 | 2.19 | 7A |

This shows that the presence of a porous membrane according to the present invention does not adversely affect the development time of the image during processing.

The dry abrasion resistance was given a ranking of 7, and the wet abrasion resistance was given a ranking of 7A, substantially greater than the Control Sample No. 1 with no protective overcoat. The fingerprint damage was 1, indicating no visible damage.

What is claimed is:

1. A method of main a photographic imaging element having a protective overcoat thereon, comprising the following steps:

(a) forming a coating composition comprising a water insoluble polymer dissolved homogeneously in a solvent mixture, said solvent mixture comprising at least one solvent which is a relatively good solvent for said water-insoluble polymer and at least one solvent which is a relatively poor solvent for said water-insoluble polymer, said relatively poor solvent having a higher boiling point than said relatively good solvent, (b) applying the coating composition to a substrate comprising at least one silver-halide light-sensitive emulsion layer and a support;

(c) drying the coated substrate to remove substantially all of the solvents to obtain a photographic element having a open-pore membrane, whereby the minimum porosity of the open-pore membrane is 20 percent.

2. The method of claim 1 wherein said water-insoluble polymer is a cellulose ester.

3. The element of claim 2 wherein said cellulose ester is cellulose acetate, cellulose acetate butyrate or cellulose acetate propionate.

4. The method of claim 1 wherein said open-pore membrane also comprises filler particles.

5. The method of claim 4 wherein said filler particles are selected from the group silicon oxide, aluminum oxide calcium carbonate barium sulfate, barium sulfate, zinc sulfide, titanium dioxide, and combinations thereof.

6. The method of claim 1 wherein said open-pore membrane also contains a crosslinking agent.

7. The method of claim 1 wherein said open-pore membrane has a thickness of about 2 $\mu$m to about 50 $\mu$m.

8. The method of claim 1 wherein said open-pore membrane also contains a wax or a polyolefin.

9. The method of claim 1 wherein said relatively good solvent is a ketone, ethyl acetate or methylene chloride.

10. The method of claim 9 wherein said ketone is acetone or 2-butanone.

11. The method of claim 1 wherein said relatively poor solvent is an alcohol, glycol, xylene, cyclopentane, cyclohexane, or water.

12. The method of claim 11 wherein said alcohol is isopropyl alcohol, isobutyl alcohol or 2-methyl-2,4-pentanediol.

* * * * *

UNITED STATES PATENT AND TRADEMARK OFFICE

CERTIFICATE OF CORRECTION

PATENT NO. : 6,455,238 B1 
DATED : September 24, 2002
INVENTOR(S) : Christine J. Landry-Coltrain et al.

It is certified that error appears in the above-identified patent and that said Letters Patent is hereby corrected as shown below:

Column 19,
Line 38, “main” change to -- making --

Column 20,
Line 23, “barium sulfate, barium sulfate” change to -- barium sulfate --

Signed and Sealed this

Seventeenth Day of June, 2003

JAMES E. ROGAN
*Director of the United States Patent and Trademark Office*